US006629857B1

(12) United States Patent
Ma et al.

(10) Patent No.: US 6,629,857 B1
(45) Date of Patent: Oct. 7, 2003

(54) ELECTRICAL CONNECTOR HAVING IMPROVED SHELL

(75) Inventors: Xuedong Ma, Kunsan (CN); GuangXing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/271,963

(22) Filed: Oct. 15, 2002

(30) Foreign Application Priority Data

Apr. 30, 2002 (TW) ..... 91205968 U

(51) Int. Cl.[7] ..... H01R 13/60
(52) U.S. Cl. ..... 439/567; 439/607
(58) Field of Search ..... 439/607, 608, 439/609, 540.1, 567

(56) References Cited

U.S. PATENT DOCUMENTS 4,645,287 A 2/1987 Olsson
5,334,049 A 8/1994 Kachlic et al.
6,074,218 A * 6/2000 Wu et al. ..... 439/63
6,086,429 A * 7/2000 Wu ..... 439/676
6,213,812 B1 * 4/2001 Kan ..... 439/607
6,319,062 B1 * 11/2001 Ma et al. ..... 439/607
6,328,603 B1 * 12/2001 Chang ..... 439/620
6,364,700 B1 4/2002 Zhu et al.
6,368,167 B1 * 4/2002 Ma et al. ..... 439/886
6,471,546 B1 * 10/2002 Zhu et al. ..... 439/607

* cited by examiner

*Primary Examiner*—Tulsidas Patel
*Assistant Examiner*—Thanh-Tam Le
(74) *Attorney, Agent, or Firm*—Wei Te Chung

(57) ABSTRACT

A shielded connector (1) mounted on a printed circuit board (40) includes an insulative housing (10), a set of conductive terminals (21,22), and a conductive shell (30,30'). The housing includes a top wall (12), a bottom wall (100), a front wall (11), a rear wall (110), and opposed sidewalls (102,104) which together define an interior space (18,19). The terminals are received in the interior space. The shell enclosing the housing includes two retention devices on each of two opposite sides thereof. Each retention device includes a hook (321,321') and a beam (325) extending through the housing. The hook is longer than the beam and has a bottom free end forming a protrusion (322,324,322') at a side edge thereof. The protrusion is adapted for engaging in a hole (41) in the printed circuit board.

10 Claims, 6 Drawing Sheets

ELECTRICAL CONNECTOR HAVING IMPROVED SHELL

BACKGROUND OF THE INVENTION

1. Field of the Invention

The present invention relates to an electrical connector, and particularly to an electrical connector having a shell for mounting the connector on a printed circuit board.

2. Description of Related Art

Electrical connectors for being mounted to printed circuit boards, typically have contact leads that extend through plated through holes or have leads that electrically engage contact pads on the surface of the printed circuit boards. Locating pins or posts are usually molded into the housing and arranged to enter into holes in the printed circuit board for accurately positioning the connector. These locating posts, sometimes include features that grip the printed circuit board to hold the connector in place. Mounting clips can also be used to both locate and hold the connector in place on the printed circuit board. Such a connector is disclosed in U.S. Pat. No. 4,645,287 which is issued on Feb. 24, 1987 to Olsson. The '287 patent discloses an electrical connector having surface mount contact leads that engage contact pads on the surface of the printed circuit board. The housing of the connector has a U-shaped groove formed adjacent to an end thereof and a U-shaped clip is closely received within the groove. The two clips have ends that extend into holes in the printed circuit board for both precisely locating the contact leads on the contact pads and securely holding the connector on the printed circuit board. This type connector requires mounting space on the surface of the printed circuit board that is equal to the size of the connector, and requires separate U-shaped clips that must be assembled to the connector before mounting the connector to the printed circuit board. In certain cases such connectors can be mounted to an edge of a printed circuit board, thereby saving board surface area for other board mounted components. Electrical connectors that are mounted to an edge of a printed circuit board, typically, utilize pins that are molded with the housing of the connector to fit into holes in the printed circuit board to accurately locate the connector so that the contact leads thereof can accurately engage with contact pads on or plated through holes in the printed circuit board. Additionally, spring clips, or similar devices, enter into other holes in the printed circuit board for firmly holding the connector housing to the printed circuit board. Such an electrical connector is disclosed in U.S. Pat. No. 5,334,049 which is issued on Aug. 2, 1994 to Kachlic et al. The '049 patent discloses an electrical connector having an insulative housing that includes a pair of flanges resting on the surface of the printed circuit board. A locating pin extends from each flange into a respective hole in the printed circuit board for positioning the connector. Each flange has a cavity receiving a metal hold down clip that includes a barbed portion extending into a hole in the printed circuit board. The metal hold down is deflected when it is inserted into the hole so that there is a continuing force urging the flanges of the connector housing to engage with the surface of the printed circuit board. While this type of connector requires less circuit board surface area for mounting, it nevertheless requires some space for the flanges, and requires both locating pins and metal hold down to effect a proper mounting.

Furthermore, electrical connectors are widely used in computers. When such connectors are used in high speed data transmission applications, the amount of electromagnetic or radio frequency interference increases. Such an electrical connector is disclosed in U.S. Pat. No. 6,364,700 which is issued on Apr. 2, 2002 to Zhu et al. This connector uses a shell stamped from a metal blank enclosing the housing for electromagnetic interference (EMI) shielding. A locking device is formed on each of two opposite side faces of the shell, each locking device including a pair of first locking legs and a pair of second locking legs. Either the first locking legs or the second locking legs have oppositely projecting protrusions for engaging with the printed circuit board, whereby the hole for receiving the first locking legs or the second locking legs has a large dimension. A large through hole in the printed circuit board causes difficulty to design the layout of the printed circuit board, particularly when the printed circuit board is small for use in a notebook computer.

What is needed is an electrical connector which can be securely mounted to an edge of a printed circuit board. A locking device for positioning and securing the connector to a printed circuit board is formed on a shell of the connector, so that no separate clip or other part to effect the mounting of the connector is required. Ideally, an improved structure will serve to position the connector, secure it to the printed circuit board for soldering and provide with an EMI shielding at the same time. Furthermore, through holes defined in the printed circuit board for receiving the locking device should have a small size to facilitate the design of layout of the printed circuit board.

Hence, an electrical connector with a shell having an improved retention structure is required to overcome the above disadvantages of the prior art.

SUMMARY OF THE INVENTION

Accordingly, a first object of the present invention is to provide an electrical connector having an improved shell with a retention structure which can securely position the connector to a printed circuit board.

A second object of the present invention is to provide an electrical connector having an improved EMI shell with a retention structure for engaging in through holes of a printed circuit board, wherein the through holes can have a small size.

In order to achieve the objects set forth, a shielded connector mounted on a printed circuit board includes an insulative housing, a set of conductive terminals, and a conductive shell. The housing includes a top wall, a bottom wall, a front wall, a rear wall, and opposed sidewalls which together define an interior space. The terminals are received in the interior space. The shell enclosing the housing includes two retention devices on each of two opposite sides thereof. Each retention device includes a hook and a beam extending through the housing. The hook is longer than the beam and has a bottom free end forming a protrusion at a side edge thereof. The protrusion is adapted for engaging in a hole in the printed circuit board.

Other objects, advantages and novel features of the invention will become more apparent from the following detailed description of the preferred embodiment when taken in conjunction with the accompanying drawings.

DETAILED DESCRIPTION OF THE INVENTION

Figure 1:
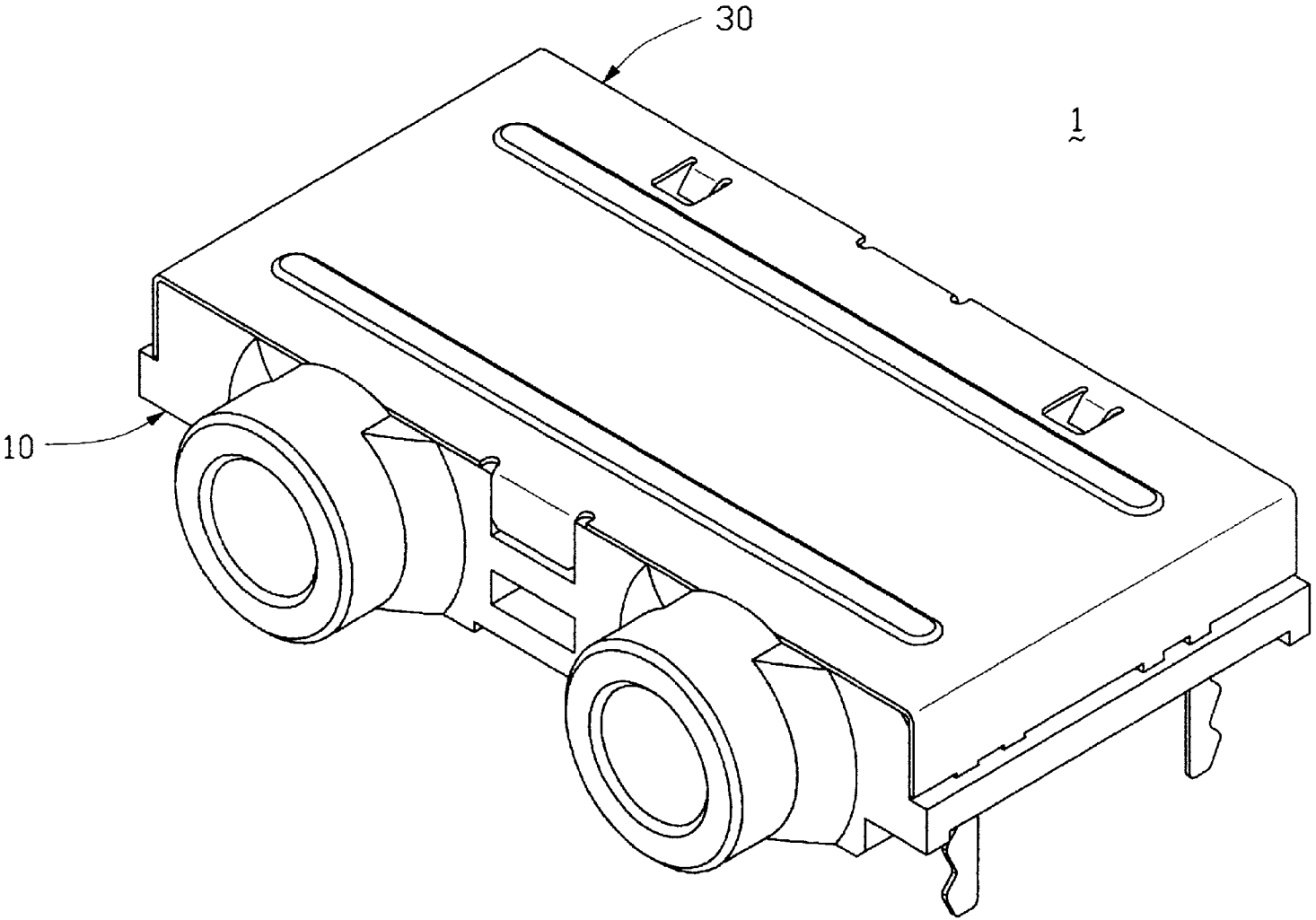
FIG. 1 is a perspective assembled view of an electrical connector of the present invention.

Reference will now be made to the drawing figures to describe the present invention in detail.

Referring to FIGS. 1–5, an electrical connector 1 constructed in accordance with the present invention for being mounted on an edge of a printed circuit board (PCB) 40 comprises an insulative housing 10, a plurality of conductive terminals 20 and a shell 30.

The housing 10 has a top wall 12, a bottom wall 100, a front wall 11, a rear wall 110 and opposed sidewalls 102, 104 which together define a first and a second interior spaces 18, 19. A first and a second sleeve portions 13, 14 project from the front wall 11 for receiving a pair of mating plugs therein for transmitting audio signals. A pair of opposite step portions 15 project outwardly from the side walls 102, 104. Each step portion defines two pairs of retaining holes 151 and apertures 155 adjacent to the retaining holes 151. The front wall 11 defines a front receiving slot 121 adjacent to the top wall 12 and locating between the first and second sleeve portions 13, 14. The top wall 12 defines a pair of openings 123, 124 adjacent to the rear wall 110. The rear wall 110 defines a rear receiving slot 122 between the openings 123 and 124. The terminals 20 comprise a first set of terminals 21 and a second set of terminals 22.

A pair of posts 16, 17 is formed on bottom faces (not labeled) of the step portions 15 for being received in holes 41 defined in the PCB 40 for positioning purpose. The bottom faces of the step portions 15 are not coplanar with a bottom face (not labeled) of the bottom wall 100 of the housing 10. Preferably the bottom face of the bottom wall 100 is lower than the bottom face of the step portion 15 (referring to FIG. 1).

Figure 2:
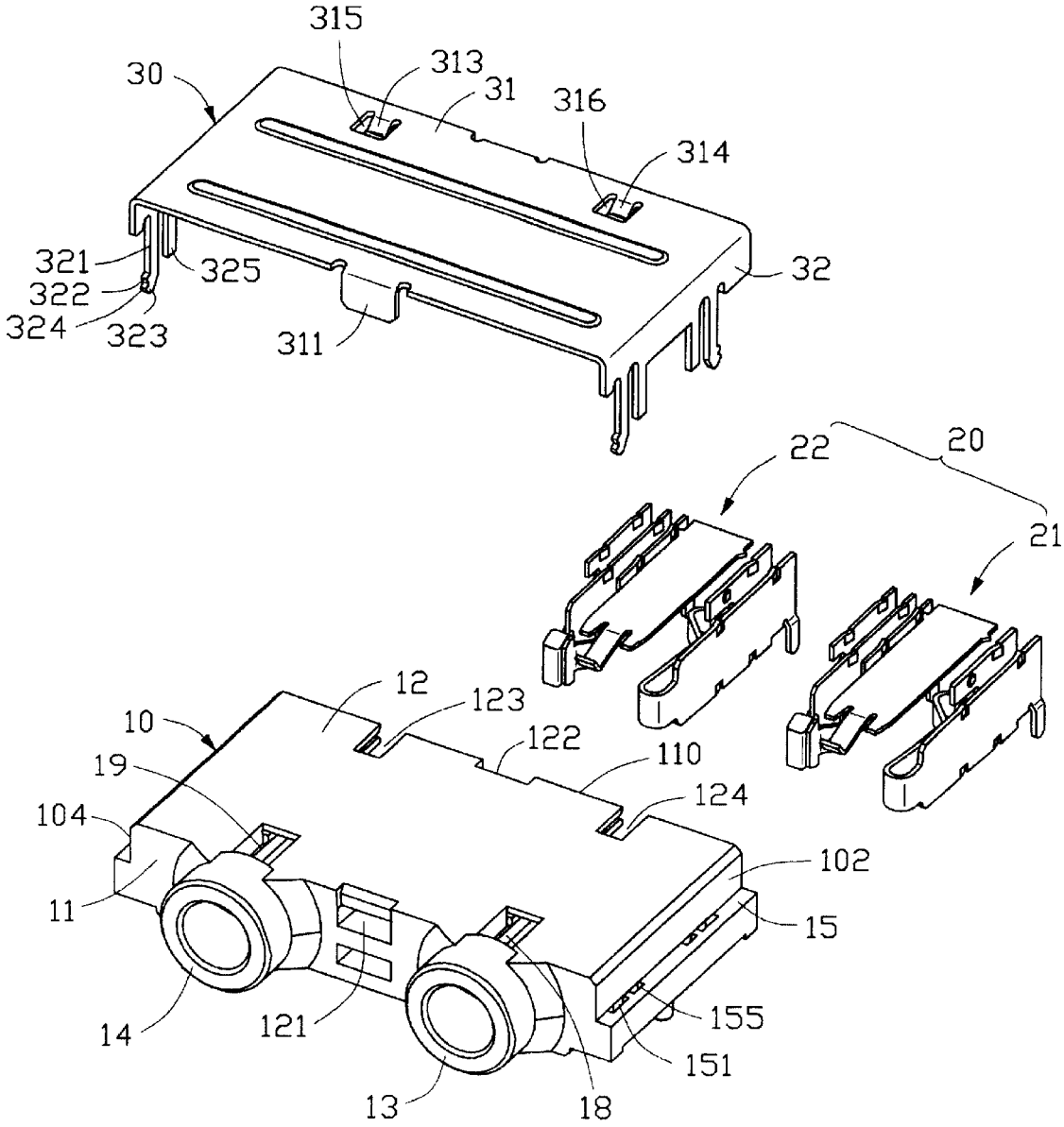
FIG. 2 is a top, exploded view of the connector of the present invention.
Figure 3:
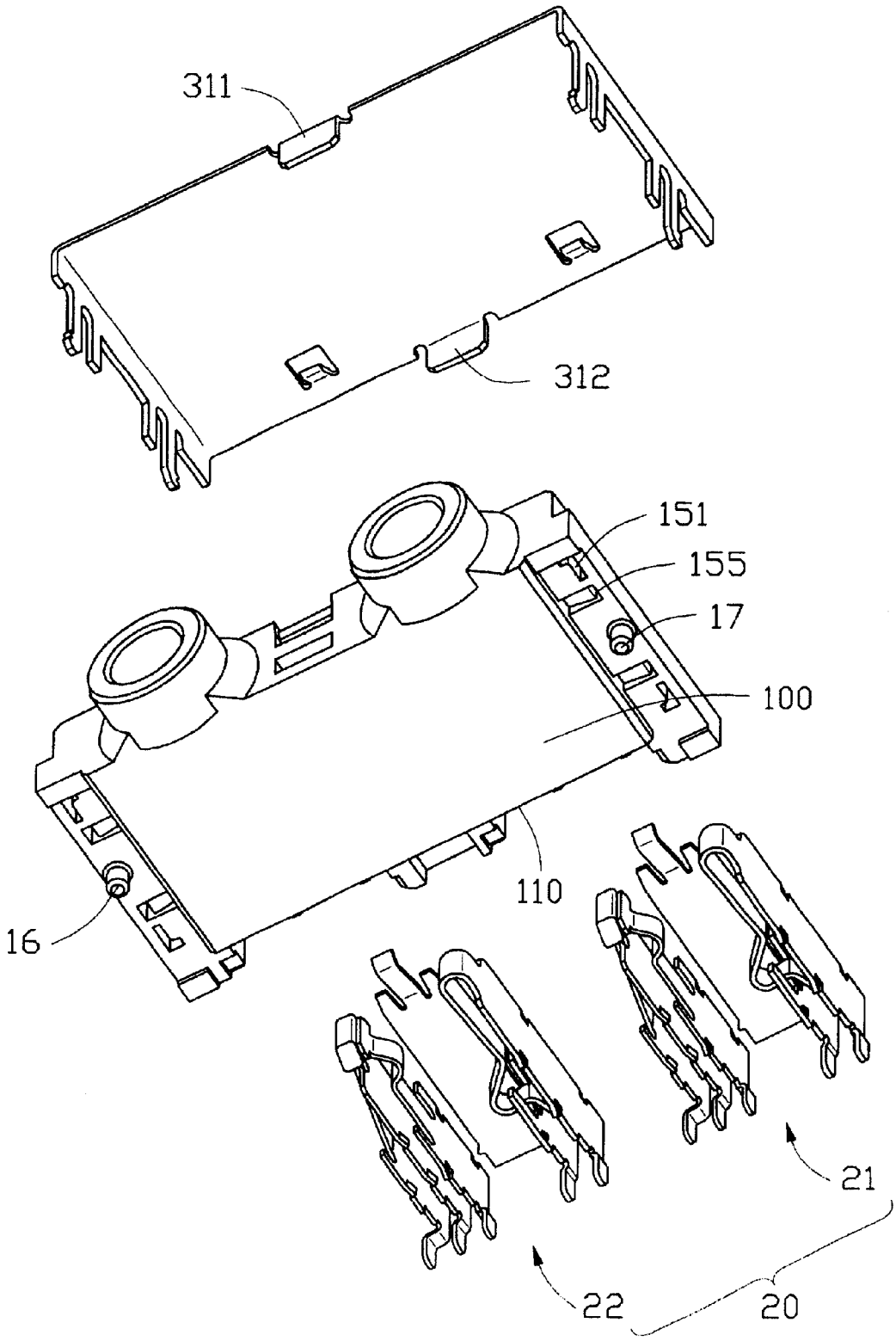
FIG. 3 is a bottom, exploded view of the connector of the present invention.

Referring to FIGS. 2 and 3, the shell 30 substantially has a U-shaped configuration. The shell 30 has an elongate upper plate 31, a front and a rear clips 311, 312 downwardly extending from a front and a rear edges of the plate 31, and a pair of side plates 32 downwardly extending from opposite sides of the plate 31. The plate 31 defines a pair of voids 315, 316 adjacent to the rear edge thereof. A pair of anchoring tabs 313, 314 extends from the plate 31 into the voids 315, 316. Two hooks 321 and two beams 325 integrally extend downwardly from each side plate 32. Each hook 321 is accompanied by a corresponding beam 325 and comprises a free end 323, and a first and a second barb portions 322, 324 projecting from a side edge of the free end 323. The barb portions 322, 324 of the two hooks 321 on the same side plate 32 point toward opposite forward and rearward directions. The beams 325 also extend downwardly from the bottom edge of the side plates 32 adjacent to the hooks 321, respectively. The hooks 321 are longer than the beams 325.

In assembly, as shown in FIGS. 1 and 2, the first and second sets of terminals 21, 22 are firstly assembled in the interior spaces 18, 19 of the housing 10 respectively from the rear wall 110. The beams 325 of the shell 30 align with the apertures 155 of the step portions 15 and the free ends 323 of the shell 30 align with the retaining holes 151 of the step portions 15. When the shell 30 is assembled to the housing 10, the free ends 323 are inserted into the retaining holes 151 and the beam 325 are inserted into the apertures 155. Finally, the anchoring tabs 313, 314 are received into the openings 123, 124 and the front and rear clips 311, 312 are received in the receiving slots 121, 122. Therefore, the shell 30 is firmly secured to the housing 10.

Figure 5:
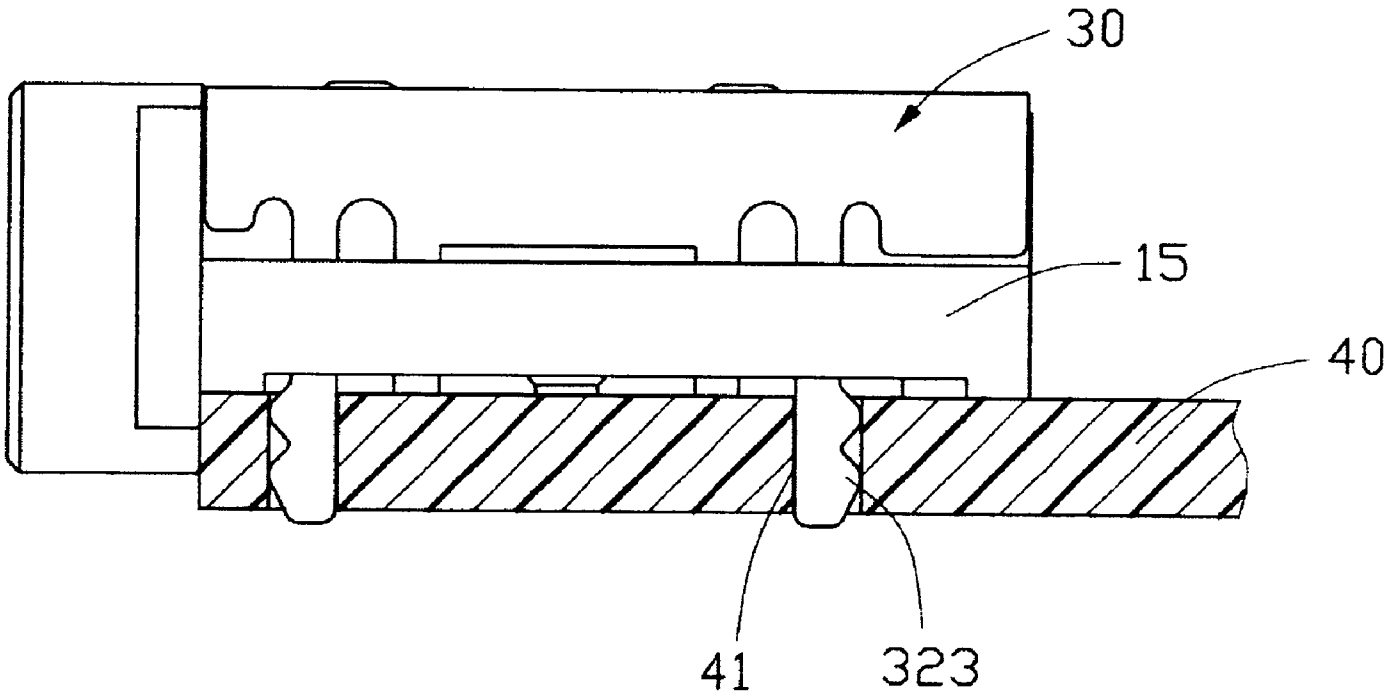
FIG. 5 is a side view of the connector of FIG. 1 mounted on a printed circuit board (PCB) shown in a cross-sectional manner.

When the shielded connector 1 is mounted to the PCB 40, as seen in FIG. 5, the free ends 323 of the hooks 321 are inserted into the holes 41 of the PCB 40 with the barb portions 322, 324 engaging with inner walls of the holes 41 of the PCB 40. Therefore, the hooks 321 of the shell 30, the posts 16, 17 and tail portions (not labeled) of the terminals 20 are received within corresponding holes defined in the PCB 40 which together secure the connector 1 onto the PCB 40. When the connector 1 is firmly mounted onto the PCB 40, the bottom face of the step portion 15 abuts against a top face of the printed circuit board 40. Furthermore, the shell 30 also provides EMI shielding on signal transmission through the connector 1.

Figure 4:
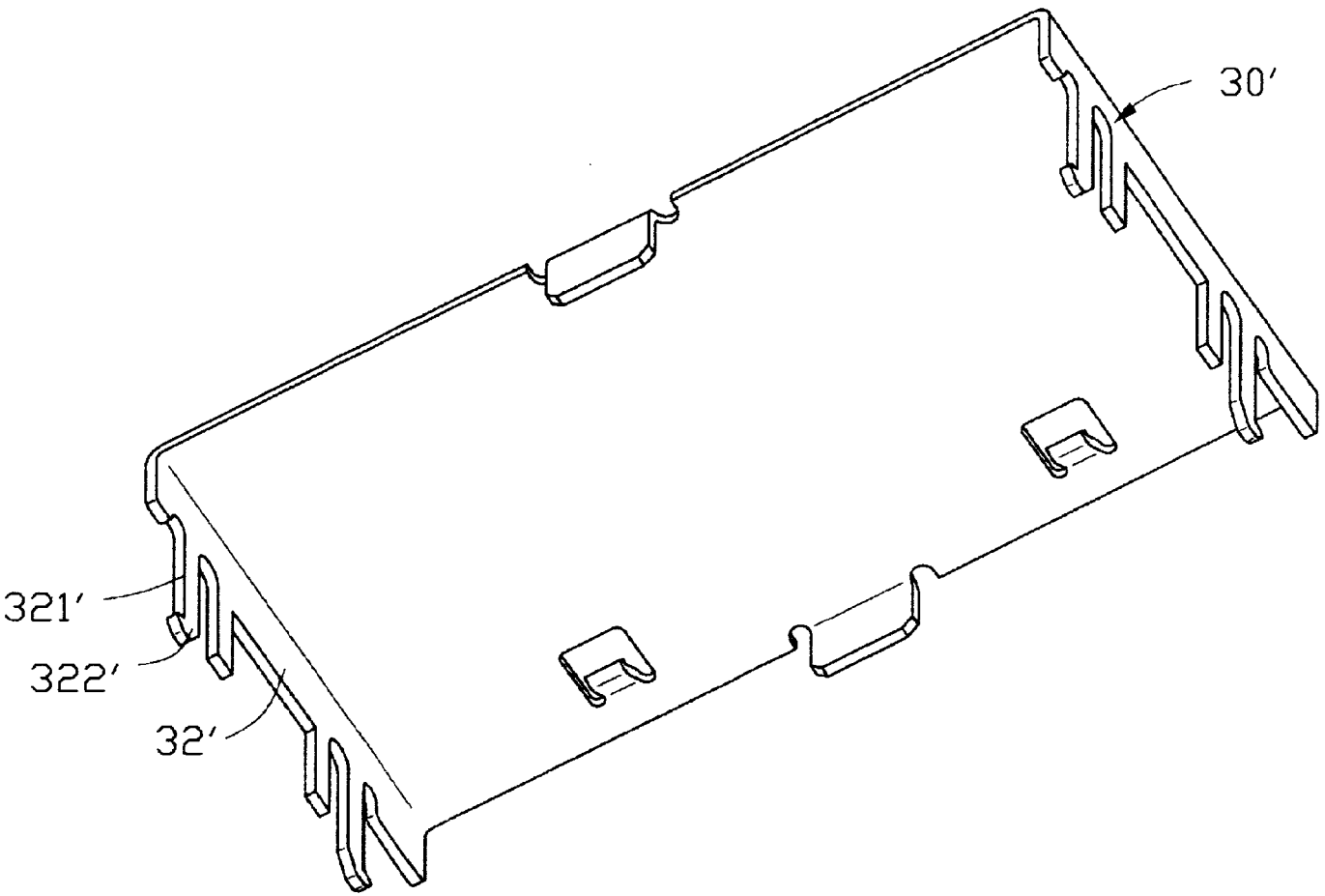
FIG. 4 is a bottom perspective view of a shell in accordance with another embodiment of the present invention.
Figure 6:
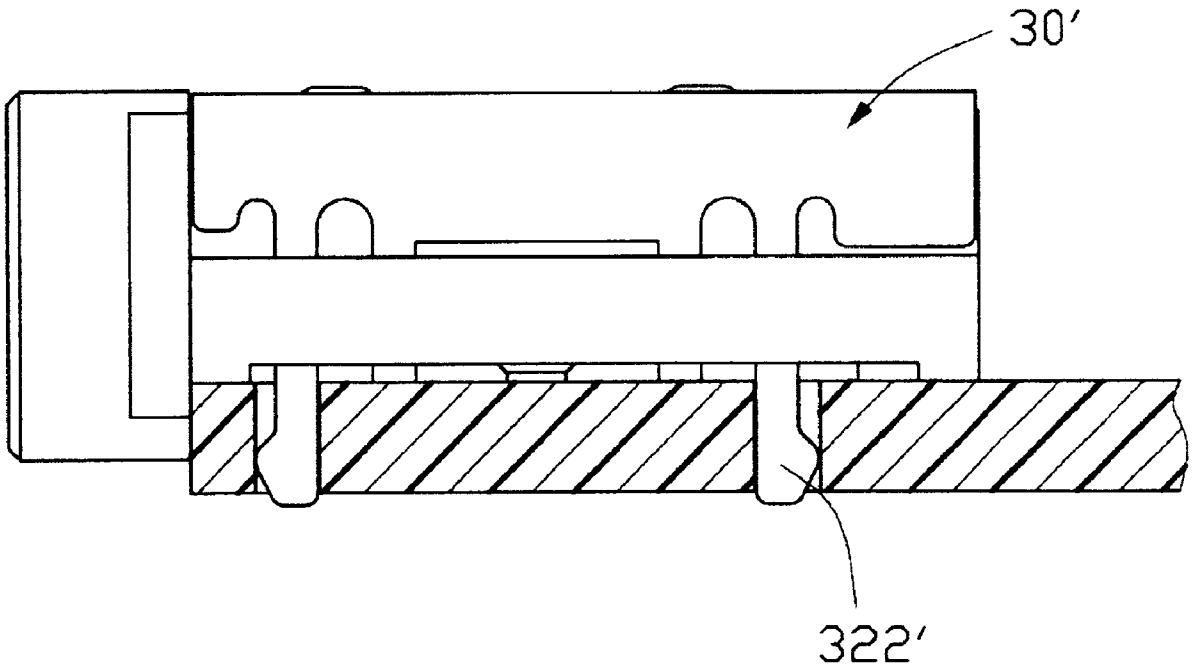
FIG. 6 is a side view of the connector with the shell shown in FIG. 4 mounted on the PCB which is shown in a cross-sectional manner.

Referring to FIG. 4, a shell 30' in accordance with a second embodiment of the present invention is disclosed. The shell 30' is substantially similar to the shell 30 except that hooks 321' extending downwardly from side plates 32' thereof each have a single barb portion 322' at a free end thereof. Referring to FIG. 6, the shell 30' is assembled onto a printed circuit board with the single barb portion 322' engaging with an inner wall of a hole defined in the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board (PCB), comprising:

an insulative housing comprising a front wall, a top wall, a bottom wall and opposed sidewalls which together define an interior space;

a set of conductive terminals received in the interior space; and a shell enclosing the housing and comprising two retention devices on each of two opposite sides thereof, each retention device including a hook and a beam extending through the housing, the hook being longer than the beam and having a bottom free end forming a protrusion at a side edge thereof, the protrusion being adapted for engaging in a hole in the PCB; wherein the protrusion of the hook comprises first and second barb portions; wherein the housing comprises a pair of opposite step portions projecting outwardly from opposed sidewalls thereof, each of said step portions defining two pairs of retaining holes and apertures; wherein the hook and the beam respectively extend through the retaining hole and the aperture of the corresponding step portion of the housing.

2.The electrical connector as claimed in claim 1, wherein the housing further comprises a sleeve portion projecting from the front wall for receiving a mating plug.

3. The electrical connector as claimed in claim 1, wherein a pair of anchoring tabs extends downwardly from a rear portion of a plate of the shell, the housing defines a pair of openings on the top wall thereof adjacent to a rear wall of the housing and the anchoring tabs are respectively received into the openings.

4. The electrical connector as claimed in claim 1, wherein said shell further comprises a pair of clips extending outwardly and downwardly from front and rear edges thereof, the housing defines a front slot in the front wall thereof and a rear slot in the rear wall thereof, the front and rear slots receive corresponding clips of the shell therein.

5. The electrical connector as claimed in claim 1, wherein the shell further comprises a pair of side plates extending downwardly from opposite sides thereof, and the retention devices integrally extend downwardly from the side plates, respectively.

6. An electrical connector for being mounted on a printed circuit board (PCB), comprising:

an insulative housing comprising a front wall, a top wall, a bottom wall and opposed sidewalls which together define a first and a second interior spaces without communicating with each other;

a first set of conductive terminals respectively received in the first interior space;

a second set of conductive terminals respectively received in the second interior space; and a shell enclosing the housing and comprising two retention devices on each of two opposite sides thereof, each retention device including a hook and a beam extending through the housing, the hook being longer than the beam and having a bottom free end forming a protrusion at a side edge thereof, the protrusion being adapted for engaging in a hole in the PCB; wherein the protrusion of the hook comprises first and second barb portions; wherein the housing comprises a pair of opposite step portions projecting outwardly from opposed sidewalls thereof, each of said step portions defining two pairs of retaining holes and apertures; wherein the hook and the beam respectively extend through the retaining hole and the aperture of the corresponding step portion of the housing.

7. The electrical connector as claimed in claim 6, wherein the housing further comprises a first and a second sleeve portions projecting from the front wall for receiving a first and a second mating plugs therein.

8.The electrical connector as claimed in claim 7, wherein a front slot is defined in the front wall and locates between the first sleeve portion and the second sleeve portion.

9. The electrical connector as claimed in claim 6, wherein a bottom face of the step portion is not coplanar with a bottom face of the bottom wall of the housing.

10. The electrical connector as claimed in claim 9, wherein a post projects downwardly from the bottom face of the step portion for further securing the housing onto the PCB.

* * * * *